US005683199A

United States Patent [19]

Tehan

[11] Patent Number: 5,683,199

[45] Date of Patent: Nov. 4, 1997

[54] ELASTIC CORD RETAINING END TIP FOR SECTIONAL POLES

[76] Inventor: Frank V. Tehan, 1801 Eastshore Hwy., Berkeley, Calif. 94710

[21] Appl. No.: 683,368

[22] Filed: Jul. 18, 1996

[51] Int. Cl.[6] ..... E04H 15/60; A45B 9/04

[52] U.S. Cl. ..... 403/314; 403/308; 403/291; 135/127; 24/136 K

[58] Field of Search ..... 403/314, 308, 403/305, 302, 301, 291; 24/300, 136 K, 136 R, 136 L; 135/127, 74, 911

[56] References Cited

U.S. PATENT DOCUMENTS

| | | | |
|---|---|---|---|
| Re. 28,067 | 7/1974 | Hyman | 135/74 |
| 111,898 | 2/1871 | Arnold | 24/136 R X |
| 870,429 | 11/1907 | Grimler . | |
| 3,448,748 | 6/1969 | Walrave | 135/127 |
| 3,963,037 | 6/1976 | Clark | 135/911 X |
| 4,236,543 | 12/1980 | Moss | 135/3 R |
| 4,706,696 | 11/1987 | Gillis | 135/102 |
| 4,945,584 | 8/1990 | LaMantia | 5/97 |
| 4,979,531 | 12/1990 | Toor | 135/104 |
| 5,029,847 | 7/1991 | Ross | 272/93 |
| 5,201,598 | 4/1993 | Tehan | 403/372 |

*Primary Examiner*—Anthony Knight

[57] ABSTRACT

An end tip for an elastic-cord-connected compactable tubular assembly (14). The tip has an insertable body portion (10) which acts as the elastic cord retainer. Because of two longitudinal channels (11) and a connecting cross hole (12), the tensioned elastic cord (13) is doubly locked and anchored onto this insertable portion of the end tip with no knots required for attachment. The locked portions of elastic cord (13) also act as a wedge to secure the end tip within the ends of the tubular assembly (14) during use, yet allow the tip/cord to be removed by hand for repair of the tubular assembly, or for elastic cord retensioning or replacement.

15 Claims, 2 Drawing Sheets

ELASTIC CORD RETAINING END TIP FOR SECTIONAL POLES

BACKGROUND—FIELD OF INVENTION

This invention relates to compactable tubular assemblies, such as tent poles, specifically to an improved device for holding the end of the interior elastic cord at the end of such assemblies.

BACKGROUND—PRIOR ART

Most contemporary tent poles comprise an assembly of telescoping tube sections. The sections are joined and bridged by tubular inserts, or by "outserts" (external tubular ferrules), and are held together by a tensioned, interior elastic cord. The sections can be separated and stacked in parallel in a compact arrangement (with the elastic cord still connecting the sections) or they can be telescopingly assembled for use and held together by the tensioned elastic cord. Currently, there are two basic approaches to the construction of this type of tent pole:

1) Press-fit end tip. In this technique, a tensioned elastic cord runs the length of the pole from an insert at the end of one end section to an insert at the end of the opposite end section. The inserts act as annular shoulders for the ends of the elastic cord to sit against. The ends of the cord are held in position by knots and washers. Independent, press-fit end tips are usually used with this technique to provide prongs which can be inserted into respective grommets on the tent, to hold the tent's corners, although glue-on tips, or even no tips, can be used.

The advantages of the press-fit end tip technique are:

a) Full-size (3.56 mm to 3.94 mm diameter) elastic cords can be used. A larger diameter, full-size elastic cord usually has better overall performance and life than a smaller diameter, thin cord.

b) The press-fit end tips are designed to be permanently affixed within the tent pole and do not easily come out of the pole during use.

c) Locking end tips can be used. The end tip can have a stem-like projection for interlocking with a mating grommet on the tent's webbing peg loop. These locking end tips are designed so they will not accidentally separate from their mating grommet during use; they must be purposefully disengaged.

The disadvantages of the press-fit end tip technique are:

a) The elastic cord does not extend the entire length of the tent pole. A shorter elastic cord has less performance and life than a longer cord.

b) Press-fit end tips can cause cracking of aluminum poles due to stress corrosion because a press-fit tip puts localized pressure and stress on the tube wall.

c) The manufacture of tent poles using the press-fit end tip technique requires more production steps than the techniques described below. For example, the installation of the press-fit end tip is an additional production step that must be done after the tent pole is assembled.

d) This technique requires the use of inserted sections; "outserts" cannot be used because the elastic cord with washer requires an internal shoulder to sit against.

e) Repair of tent poles with press-fit end tips usually requires the use of a repair device, such as shown in Tehan, U.S. Pat. No. 5,201,598 (Apr. 13, 1993), to avoid the difficult job of press-fit end tip removal.

2) Elastic cord retaining end tips. This is a technique where the elastic cord extends the entire length of the tent pole and where both ends of the tensioned cord are attached to their respective, opposing end tips. The end tips are basically loose within the tent pole: they are held in position only by the pulling force from the tensioned elastic cord to which they are attached. There have been two prior techniques using this method of tent pole construction:

a) The knotted end tip. Here the elastic cord passes through either a cross (transverse) or longitudinal hole in the tip, and a knot in the end of the cord holds it to the tip. A disadvantage of this technique is that because of space limitations within the tube, and because of the way the elastic cord must be knotted, either to itself or seated against the tip, the cord must be relatively thin, usually about 2.79 mm in diameter. A thin cord will have weak tension and pulling force on the end tip, allowing the tip to "pop out" of the pole relatively easily during use.

b) The jam-slot end tip. This was a short-lived technique used in the early 1980s by Recreational Equipment Inc. of Sumner, Wash. Here the elastic cord passes through a cross (transverse) hole in the body of the tip. The cross hole has a thin jam-slot at its rear by which the cord is held in position within the tip. This technique can use a full-size elastic cord because no knots are required for the cord's attachment to the tip. However, the lack of a retaining knot and the thin jam-slot are basic flaws of this design. Should the end tip, with its elastic cord attached, be accidentally "popped out" of the tent pole during use, the cord can be easily stripped out of the jam-slot, causing the pole to come apart and, possibly, the tip to be lost.

The advantages of the above elastic cord retaining end tip techniques over the press-fit end tip technique are:

a) The poles have the benefit of an elastic cord extending the entire length of the tent pole. A longer elastic cord doing the same job required of a shorter cord results in less tension and stress on the cord and better performance and cord life.

b) Tent pole manufacture, repair, and elastic cord retensioning or replacement are relatively simple since elastic cord retaining end tips are visible, accessible, and removable by hand. The end tips are installed as an integral part of the tent pole assembly process and do not have to be installed in a secondary operation, after pole assembly, as is the case with press-fit end tips. No additional parts, such as washers, or repair devices, or special tools are required.

The disadvantages that are common to the above elastic cord retaining end tip technique are:

a) The end tips are basically loose within the tent pole, held in position only by the pulling force from the tensioned elastic cord to which they are attached. As a consequence, an end tip of this type can accidentally "pop out" of the pole during use. In the case of the jam-slot tip, this can result in the pole's coming apart, as described above.

b) Locking end tips cannot be used with this technique because they would only exacerbate the above problem.

Objects and Advantages

Accordingly several objects and advantages of the present invention are:

a) to provide an improved elastic cord retaining device or end tip for tent poles and other sectional pole assemblies;

b) to provide an end tip that will not accidentally "pop out" of the tube during use, but will still be removable by hand for tube repair or elastic cord retensioning or replacement;

c) to provide an end tip that does not require the use of any knots, washers, repair devices, or special tools for manufacture, repair, or elastic cord retensioning or replacement; and, d) to provide an end tip that can be designed to accommodate any of the sizes of elastic cord commonly used in tent poles: thin, medium, and full size.

Other objects and advantages are:

a) to provide an elastic cord retaining end tip that uses not only the cord's tension to aid in holding the tip within the tube, but also uses the cord's compressibility to wedge and secure the tip in position; and, b) to provide an end tip that can use any external tip design, including locking.

Further objects and advantages will become apparent from a consideration of the drawings and the ensuing description.

DRAWING REFERENCE NUMBERS

Figure 1:
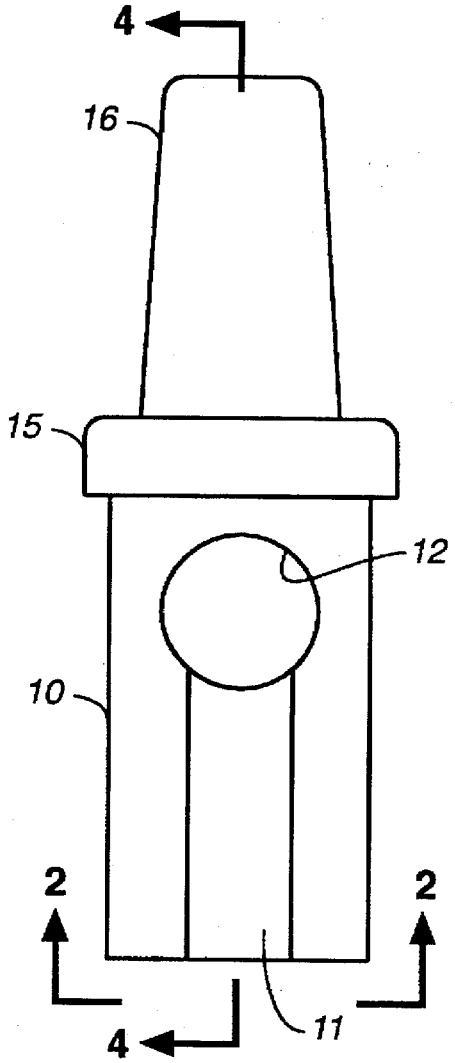
FIG. 1 is a side view of an end tip for holding an elastic cord within a compactable assembly of tubes, in accordance with the invention.

10 body (insertable portion)
11 locking channels
12 cross hole
13 elastic cord
14 tube
15 collar
16 tapered prong

DESCRIPTION OF INVENTION

Figure 2:
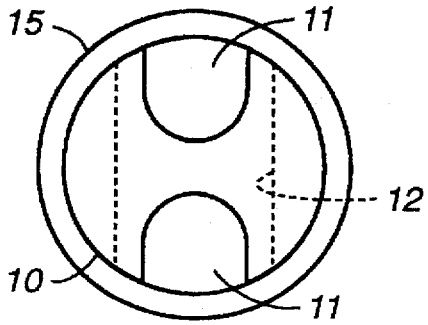
FIG. 2 is a view from the rear, or bottom end, of the tip of FIG. 1.

A typical embodiment of my end tip (FIG. 1) comprises a lower, insertable portion or body 10, a flange or collar 15 in the middle, and a tapered prong 16 as the upper, external portion. Body 10 is cylindrically shaped (FIG. 2) and has two locking grooves or channels 11, one of which is shown in longitudinal profile in FIG. 1. Body 10 also has a cross or transverse hole 12 which communicates with the base of each channel 11, so as to connect the channels at their base. Locking channels 11 oppose each other and are parallel and longitudinal and extend in from the sides of body 10 (FIG. 2). They also extend from both ends of cross hole 12 to the rear or bottom surface of body 10, i.e., the lower end in FIG. 1. The rear surface of body 10 is circular, flat, and perpendicular to the sides of body 10.

Figure 4:
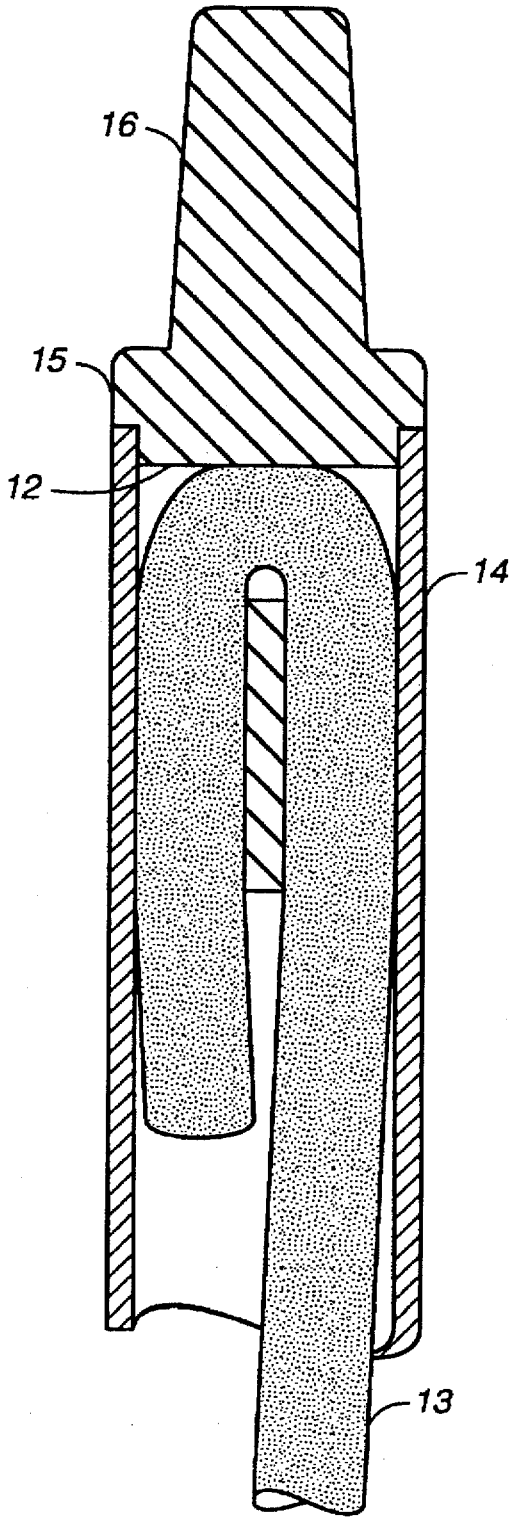
FIG. 4 is a side sectional view of a tube with end tip and elastic cord of FIG. 3 inserted.
Figure 5:
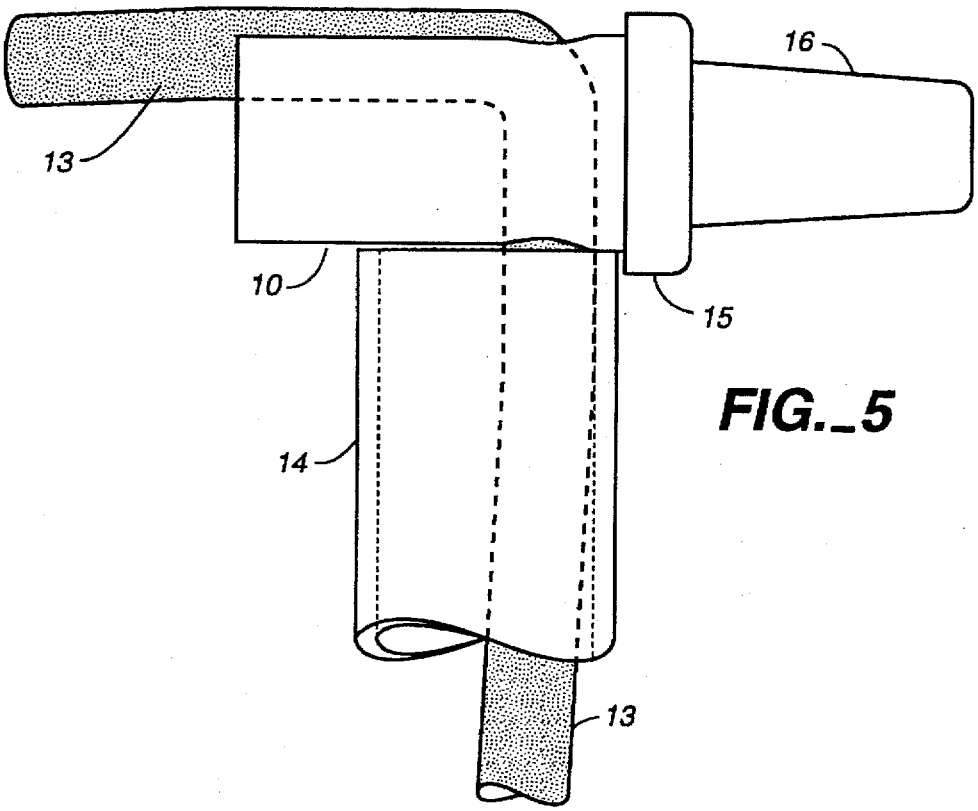
FIG. 5 is a side view of a "popped out" end tip with an elastic cord in only one locking channel.
Figure 3:
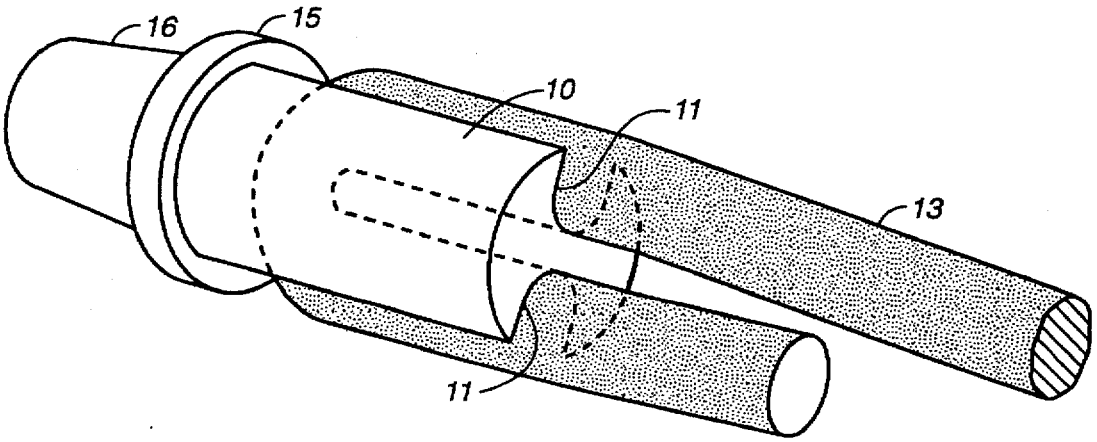
FIG. 3 is an angled view of end tip of FIG. 1 with an elastic cord attached.

Collar 15 has a wider diameter than body 10 and forms a ledge facing the rear of body 10 so as to prevent body 10 from being pulled into the tent pole. Prong 16 is tapered in the forward direction (upward in FIG. 1) and is narrower than body 10. An elastic cord 13, extends through and out of the lumen of a tube 14 (FIG. 3). Cord 13, which has a slightly greater diameter than the width and depth of channels 11, is attached to body 10 (FIG 3) by dressing or laying it in one of locking channels 11, inserting it through cross hole 12, and dressing or laying it in the other of channels 11. The combination tip/cord then is press-inserted into tube 14 as shown in FIG. 4. FIG. 5 shows the tip/cord "popped out" of tube 14 and will be explained below.

In one embodiment, the tip was 33.34 mm long, body 10 was 7.54 mm in diameter, channels 11 were 2.38 mm wide, 2.92 mm deep (FIG. 2), and 9.53 mm long, hole 12 was 4.45 mm in diameter, and cord 13 was 3.68 mm in diameter and was made of a rubber core with a woven nylon outer sheath and a woven cotton inner sheath. Preferably the tip is made of engineering resins (plastic).

Operation

FIG. 3 shows tube 14 with the tip and cord 13 extending out of the tube. Cord 13 is laid over and along the top edges of the top locking channel 11. (This stage is not shown.) Cord 13 then is inserted through cross hole 12, as shown in FIG. 3, and is laid over and along the top edges of the bottom, opposite locking channel 11. (This stage is not shown.) Cord 13 then is stretched and firmly pressed and squeezed down into both locking channels 11, as shown in FIGS. 3 and 4. Once into channels 11 and through hole 12, cord 13 is doubly locked onto the end tip, i.e., by the hole and channels. Lastly, the end tip, with cord 13 attached, is press-inserted into tube 14 (FIG. 4).

Locking channels 11 perform two very important functions:

1) They grip and lock cord 13 to the end tip because channels 11 are narrower in width than the diameter of cord 13. If the end tip is accidentally "popped out" of tube 14 during use (unlikely), the tensioned portion of cord 13 that extends through tube 14 will be stripped out of its locking channel. However, the tension of cord 13 through hole 12 will pull the free portion of cord 13 down tightly into its locking channel. Thus, as shown in FIG. 5, the end tip will not come free of the cord even when the tip is out of the tube, with its side against the end of the tube, and the cord is out of one locking channel.

2) Channels 11 cause cord 13 to wedge and secure the end tip within tube 14 because channels 11 are shallower in depth than the diameter of the cord. This causes a portion of cord 13 to protrude above the surface of body 10. When the tip, with cord 13 attached, is press-inserted into tube 14, cord 13 is compressed. The resultant wedging pressure of cord 13 against the inner wall of tube 14 secures the tip within the tube during use. Still, the end tip with its attached elastic cord is removable by hand.

The amount of gripping force on cord 13 and the amount of wedging pressure of cord 13 against tube 14 both can be predetermined by altering the width, depth and length of channels 11 in relation to the diameter of the cord.

It is usual for tent poles to have tips at both ends. Therefore, with my end tip at both ends, cord 13 extends the entire length of the pole, with attachment of cord 13 to tips, and wedging of the tips/cord within tube 14, being identical at both ends.

Replacement of the tip or the cord is easily done by removing the tip and end of the cord by means of a twisting and pulling action of the fingers and then stripping cord 13 out of channels 11 and hole 12 and installing the new parts as described above. The tension of cord 13 can be adjusted up or down in a similar way: remove tip and cord as above, strip cord 13 out of channels 11, adjust position of cord 13 in hole 12 by pulling it tighter or looser, then push cord 13 back into channels 11, and reinsert the tip, with cord 13 attached, back into tube 14.

Prong 16 is designed to mate with grommets at the base of the tent (not shown) and is one of the main connecting points of the pole to the tent.

Conclusion, Ramifications, and scope

The reader will see from the above that my longitudinal channels grip and lock the elastic cord to the end tip, which results in the cord being doubly locked by a total gripping surface of over twelve times the surface area of the prior-art jam-slot end tip. Further, these locking channels cause the cord to wedge and secure the tip within the tube, which is an improvement over any prior-art elastic cord retaining end tip.

Some additional advantages of my end tip are:

a) The two locking channels on the body of my end tip can be shaped to accommodate and hold in position almost any size elastic cord: thin, medium, or full size. The locking channels also can be shaped to lessen or increase the amount of wedging pressure of the cord against the wall of the tube in order to make removal of the tip/cord from the tube as easy, or as hard, as required by the tent pole application.

b) Tent pole manufacture is faster and more economical using my end tip because it not only replaces the knot and washer used in the press-fit end tip technique, but its use eliminates two manufacturing operations: seating of the knots/washers against the inserts of the pole's end sections, and press-fit end tip installation. Potential damage to the pole's tube ends from careless press-fit end tip installation is also eliminated.

c) Tent pole repair is simple with my end tip because it is visible, accessible, and hand removable: no special tools, repair devices, or elastic knots and washers are required. Elastic cord retensioning or replacement can be done in the field. Worn or corroded end tips can be easily replaced, which is not the case with press-fit end tips.

d) The elastic cord extends the full length of the tent pole with my end tip, which means there is more elastic cord doing the same job when compared with the shorter length cord in the press-fit end tip technique. The elastic cord is under less tension and stress and should perform better, especially in extreme temperatures, and should last longer. Shorter two-, three-, and four-section poles are especially benefitted because of the large percentage of additional elastic cord.

e) My end tip allows tent poles to be designed using either inserts or "outserts" as the telescoping joints of the tent pole's sections. Tent poles using the press-fit end tip technique can use only pole sections with inserts because the knotted elastic cord with washer must have an internal shoulder to sit against.

f) My end tip allows more freedom of tent pole design because end sections without telescoping inserts can be used, which is not the case with the press-fit end tip technique; end sections with inserts must be used with that technique. Consequently, minimum folded lengths of the tent pole can be achieved using fewer different section lengths. My end tip makes even two-section tent pole designs quite practical and economical to manufacture.

g) My end tip completely eliminates stress corrosion cracking of aluminum tent pole tube ends that can occur with press-fit end tips.

h) All commonly used end tip designs can be incorporated into my tip: tapered, locking, ball, and dome.

i) My end tip can be made of metal or engineering resins, be machined, forged, cast, or injection molded, whichever material or process produces the best end tip for the required application.

Although my above description contains many specificities, these should not be construed as limitations on the scope of my invention, but rather as an exemplification of a preferred embodiment thereof. Many variations are possible within its scope. For example, the sizes, materials, and shapes of the end tip can be varied. It can have an oval, square, or rectangular, rather than a circular cross section, and it can be designed to accommodate more than one elastic cord. The locking channels need not necessarily be opposing (180 degrees apart), straight, or parallel, but can be offset, curved, or helical. They can be undercut (wider at the bottom than at the top), or flared out slightly from bottom to top, or of a circular cross section with the top opening being the chord of the circle. The cross hole can be non-symmetrically positioned with relation to the body or angled at other than 90°. Ribs or indents can be added to the surface of the walls of the locking channels to more firmly grip the elastic cord. Where a less easily removable tip is required, the surface of the body portion of the tip can have protrusions added that exert additional pressure against the tube's inner wall to more firmly hold the tip in position within the tube. In lieu of being used with sectional tent poles, my tip can be used with any other sectional tube assembly which is held by an inner elastic cord, such as canes, arrows, walking sticks, structural members of easily erectable structures, etc. When it is desirable to have the elastic cord not run the entire length of the pole to the end tips, but to a point, or points, within the pole, a concealed plug consisting only of the body of my tip, without collar and tapered prong, can be inserted within the pole as an anchor for the elastic cord. The elastic cord is attached to one or more locking channels on the plug and the plug itself is held in position within the pole by the wedging action of the cord, in the manner of my end tip.

Thus, the scope of my invention should be determined by the appended claims and their legal equivalents, rather than by the examples given.

I claim:

1. In a collapsible tubular assembly having an internal elastic cord interconnecting various tubular sections, an end tip for adjustably retaining an end of said elastic cord at a first of said tubular sections, said tip comprising:

an insertable portion having a side surface and a rear surface, a hole extending through said insertable portion, said hole having both ends exiting at spaced areas of said side surface, and two channels on said side surface, said channels extending from said respective ends of said hole to said rear surface of said insertable portion, said channels having a predetermined width and depth slightly less than the diameter of said elastic cord in a relaxed state, whereby when said insertable portion of said end tip is inserted in said first tubular section together with said elastic cord end that can be adjustably tensioned in said two channels and hole, said end tip and elastic cord combination form a wedge fit in said first tubular section as said tensioned cord tends toward a relaxed state.

2. The end tip of claim 1 wherein said insertable portion is cylindrically shaped.

3. The end tip of claim 1 wherein said rear surface is circular and in a plane perpendicular to a centerline of said insertable portion.

4. The end tip of claim 1 wherein said channels are longitudinal, parallel, and 180° apart.

5. The end tip of claim 1 wherein the walls of said channels are straight, parallel, and equal in shape.

6. The end tip of claim 5 wherein said channels are parallel to the longitudinal cross-sectional plane of said insertable portion.

7. The end tip of claim 1 wherein said channels each have a bottom with a concave profile.

8. The end tip of claim 1 wherein said elastic cord extends through said two channels and said hole for easy and rapid removal or adjustment.

9. The end tip of claim 1 wherein said tip comprises said insertable portion, a collar, and a projection in the shape of a truncated cone.

10. In a tube and an internal elastic cord combination, an end tip for adjustably holding the end of said elastic cord at the end of said tube, said end tip comprising:

a body portion having a predetermined diameter for insertion into said tube, said body portion having a side, a rear end, and an opposite end, and a collar at said opposite end of said body portion and having a predetermined diameter wider than that of said tube for prevention said tip from being completely inserted into said tube, and wherein said body portion further comprises a plurality of grooves or channels at spaced locations on said side of said body portion, said grooves communicating with said rear end, and a hole extending through said body portion and communicating with said grooves said grooves having a predetermined width and depth less than the diameter of said elastic cord in a relaxed state, whereby said elastic cord is combined with said body portion by feeding the end thereof into said grooves and hole to form a fully adjustable wedge fit when said body and cord combination is inserted into said tube.

11. The tip of claim 10, further including a front portion extending from said collar.

12. A method of adjustably holding an end of an elastic cord at the end of a tube in a tubular assembly, comprising the steps of:

providing an end tip comprising a body portion having a predetermined diameter for insertion into said tube, said body portion having a side, a rear end, and an opposite end, and a collar positioned at said opposite end of said body portion and having a predetermined diameter wider than that of said tube for preventing said tip from being completely inserted into said tube, said body portion having a plurality of grooves or channels at spaced locations on said side of said body portion, said grooves having a predetermined width and depth communicating said rear end, and a hole extending through said body portion and communicating with said grooves, providing said elastic cord, the diameter of said cord in a relaxed state being greater than the predetermined width and depth of said grooves in said tip, providing said tube, said tube having an open end, said cord being positioned in the lumen of said tube, stretching said cord into one of said grooves in said tip, through said hole in said tip, and into the other of said grooves of said tip, adjusting said cord in said grooves for a proper fit for said tubular assembly, inserting said body portion of said tip in combination with said cord in said stretched state into said tube, so that said tip and cord combination is wedged in said tube when said cord tends to relax.

13. The method of claim 12 wherein said grooves in said body portion of said tip are longitudinal, parallel and spaced 180° apart on said body portion of said tip.

14. The method of claim 12 wherein said tip also includes a front portion extending from said collar.

15. The method of claim 12 wherein said rear surface of said tip is circular and in a plane perpendicular to a centerline of said body portion.

* * * * *